US007438673B1

(12) United States Patent
Jones

(10) Patent No.: US 7,438,673 B1
(45) Date of Patent: Oct. 21, 2008

(54) RECIPROCAL INHIBITION BODY TONER APPARATUS

(76) Inventor: Tom Jones, 4531 Scenario Dr., Huntington Beach, CA (US) 92649

( * ) Notice: Subject to any disclaimer, the term of this patent is extended or adjusted under 35 U.S.C. 154(b) by 0 days.

(21) Appl. No.: 11/261,183

(22) Filed: Oct. 27, 2005

Related U.S. Application Data

(63) Continuation-in-part of application No. 11/187,514, filed on Jul. 22, 2005, now abandoned.

(51) Int. Cl.
*A63B 21/00* (2006.01)

(52) U.S. Cl. ..... 482/71; 482/907; 482/51

(58) Field of Classification Search ..... 482/131, 482/71, 70, 141, 907, 908, 142, 121, 130, 482/133, 139, 51
See application file for complete search history.

(56) References Cited

U.S. PATENT DOCUMENTS 4,506,884 A * 3/1985 Hankin ..... 482/131
5,147,266 A * 9/1992 Ricard ..... 482/131
5,279,532 A * 1/1994 Chen ..... 482/71
5,503,609 A * 4/1996 Bull ..... 482/70
6,368,254 B1 * 4/2002 Wall ..... 482/71
7,134,987 B2 * 11/2006 Goldstein ..... 482/141

* cited by examiner

*Primary Examiner*—Jerome Donnelly
(74) *Attorney, Agent, or Firm*—Dennis W. Beech

(57) ABSTRACT

The present invention may be used for human exercise. A track assembly may have two bottom cross members attached approximately perpendicular thereto and extending approximately horizontally from each side of the track assembly. Two vertical frame members may be attached to a first end of each of the bottom cross members. A handle may be attached at an upper end of each of the vertical frame members. A seat may be disposed in an upper portion of the two vertical frame members for seating to face a second end of the bottom cross member.

48 Claims, 7 Drawing Sheets

20
30
74
74
32
18
18
76
72
82
70
40
42
50
56
130
132
46
48
45
44
56
50
52
54
132
130
58
62
60
54
134
54
46
45
65
72
70
66
64
44
42
70
73
80
28
25
26
32
73
80
70
45
48
66
65
12
78
25
84
70
72
42
82
40
72
70
44
70
73
70
42
48
49
45
46

RECIPROCAL INHIBITION BODY TONER APPARATUS

This is a continuation-in-part of U.S. patent application Ser. No. 11/187,514 filed on Jul. 22, 2005. U.S. patent application Ser. No. 11/187,514 is abandoned.

BACKGROUND OF THE INVENTION

The invention relates to apparatus for use in exercising the upper and lower body muscles, ligaments and tendons. The new apparatus allows exercising using the principles of reciprocal inhibition, which may occur when a muscle contracts during a desired motion thereby forcing an opposite muscle group to relax, and other exercising regimen.

There may be currently existing apparatus for exercising the human body. These exercise apparatus may have leg exercising elements with provision for body twisting, arm exercising or perhaps sitting on a portion of the apparatus to perform certain exercises. The new apparatus combines a simple improved body exercise structure with handle elements, a seat and alternatively positionable elastic force elements for exercise use.

SUMMARY OF THE INVENTION

The present invention is directed to apparatus for human exercise. A track assembly may have two bottom cross members attached approximately perpendicular thereto and extending approximately horizontally from each side of the track assembly. Two vertical frame members may be attached to a first end of each of the bottom cross members. A handle may be attached at an upper end of each of the vertical frame members. A seat may be disposed in an upper portion of the two vertical frame members for seating to face a second end of the bottom cross member.

These and other features, aspects and advantages of the present invention will become better understood with reference to the following drawings, description and claims.

DETAILED DESCRIPTION

Figure 1:
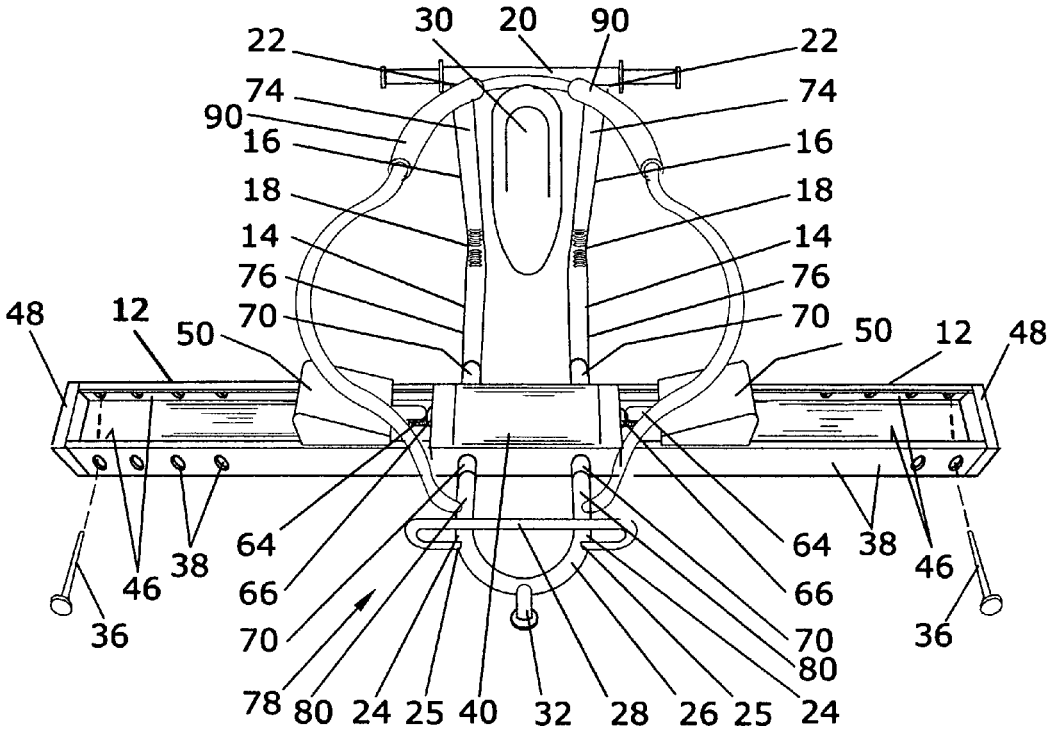
FIG. 1 illustrates a front perspective elevation view of the exercise apparatus according to an embodiment of the invention.
Figure 4:
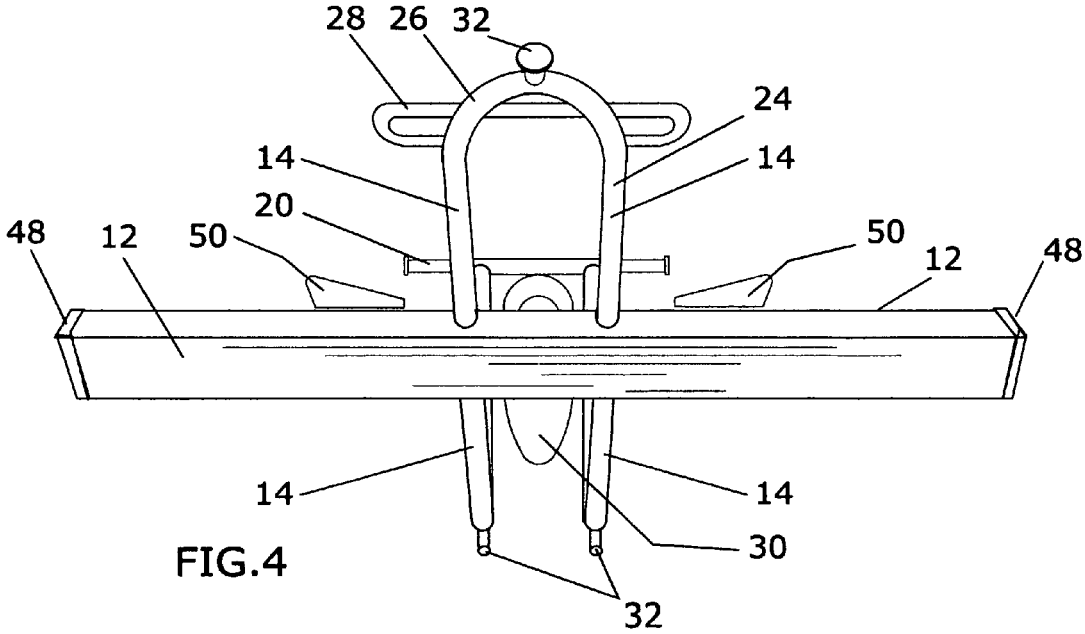
FIG. 4 illustrates a bottom perspective view of the exercise apparatus according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, the reciprocal inhibition body toner apparatus 10 may have a track assembly 12 with two bottom cross members 14 attached approximately perpendicular thereto and extending approximately horizontal from each side of the track assembly 12. There may be two vertical frame members 16 attached to a first end 18 of the cross members 14. A handle 20 may be attached at an upper end 22 of each vertical frame member 16. A second end 24 of the cross members 14 may be connected by a bridging cross member 26 that may have a curved form or shape.

There may be a grip bar 28 that may be approximately oval in shape that may be attached to the bottom cross members 14 adjacent the second ends 24. There may be a seat 30 attached to the handle 20, to the vertical frame members 16 or to grip bar 28 that may be oriented for a user to sit facing the grip bar 28 or the vertical frame members 16. The grip bar 28 may extend generally upwardly from the bottom cross members 14 for gripping by a user when exercising using the track assembly 12 as well as when seated in the seat 30. The grip bar 28 may also be used to perform push-ups, mountain climbing exercises, step exercises as well as other exercises requiring an elevated position. There may be a seat support member 120 attached to and extending downwardly from the handle 20 between the vertical frame members 16. The seat 30 may have a seat collar clamp 122 attached to the back and the seat collar clamp 122 may be slidably disposed on the seat support member 120 to allow vertical adjustment of the seat 30 elevation. There may be a clamp lever 124 engaged with the seat collar clamp 122 to allow tightening and loosening of the seat collar clamp 122 on the seat support member 120.

A user may exercise by placing their feet on the foot pad assembly 50 of the track assembly 12 and griping the handle 20 for balance or other support in moving the torso, legs and feet. There may be one or more pin apertures 38 in rail channel 46 for insertion of a track pin 36 to stop the outward motion of the foot pad assembly 50. The handle 20 may be a tubular structure attached to be oriented parallel to the track assembly 12. The user may also use the grip bar 28 for support in exercising using the track assembly 12. Further, a user may use the seat 20, track assembly 12, handle 20 and grip bar 28 in various combinations for exercise. Examples of exercises may include: a person sitting in the seat 30 when attached to grip bar 28, bending over and placing a hand on each of the foot pad assemblies 50, and exercising against the force of the elastic force element 64 to exercise the arms and upper body; and sitting in the seat 30 when attached to the handle 20, placing a foot on each of the foot pad assemblies 50, and exercising against the force of the elastic force element 64.

Referring to FIGS. 2, 5, 6, 7, 8 and 13, the track assembly 12 may have a connector element 40 of generally rectangular shape that may have opposed recesses 42 for slidable receipt of an end of a track member 44. The track members 44 may have the form of a C channel having a rail channel 46 on each side thereof. The track members 44 may be inserted in the connector element 40 for a friction engagement. While the connector element 40 may be described and illustrated as generally rectangular in shape, other connector element configurations or forms may be used. For example, the track members 44 may be slidably inserted in other exercise elements or apparatus that have the provision of recesses 42 of proper shape for receipt of the track member ends 45. The track members 44 may be connected in a more universal exercise apparatus. The end of a track member 44 may also be attached to the connector element 40 by other methods. For example, recesses 42 may be covered with a plate 116 and a flange 115 may be disposed for receipt of a flange 114 attached to the end plates 48. The track members 44 may have flanges 114 on the end plate 48 at each end 45, reference FIG. 16. The track members 44 may also be attached to the plate 116 by fasteners, for example, screws, bolts and the like.

A footpad assembly 50 may have a wheeled platform 52 with wheels 54 for rolling engagement with rail channels 46. There may be a footpad 56 rotatably attached to the top of the wheeled platform 52. An extension arm 58 may be attached to the wheeled platform 52 that may extend horizontal outwardly therefrom and may have an elastic support connector 60 at a distal end 62.

The wheels 54 may be inserted in rail channels 46 with the elastic support connector 60 disposed to extend outwardly relative to the connector element 40. An elastic force element 64 may be attached to the elastic support connector 60 at a proximal end 65 and to an elastic connector 49 of an end plate 48. The elastic force element 64 that may be a spring 110 with a spring hook 112 at each end or other suitable element may urge the footpad assembly 50 toward the connector element 40. Depending on the type of elastic force element 64 used in the apparatus 10, the length of the extension arm 58 may be varied for proper exercise support, or the extension arm 58 may not be necessary and the elastic force element 64 may be attached to the wheeled platform 52. There may be a platform end plate 130 attached to the wheeled platform 52 at each end and to the wheel side plates 134. The platform end plates 130 may have a hook 132 attached in position for engagement with an elastic force element 64. Depending on the amount of force desired for an exercise, various springs may be used with the track assembly 12.

The track member 44 may have end plates 48 with T slots 49 for retaining a proximal or second end 65 of the elastic force element 64. The proximal end 65 may have an eye element, T connector, hook or other device for insertion and retention in the T slot 49. The end plate 48 may also have hooks 132 rather than slots 49 for retaining an end of an elastic force element 64. The hook 132 may also be a closed ring or loop for receipt of a hook 132 on an elastic force element 64. There may be a foot pad stop 66 that may have a slot 68 for disposing the foot pad stop 66 on the elastic force element 64. The foot pad stop 66 may have a longitudinal length designed to stop the foot pad assembly 50 at a distance from the end plate 48 or the connector element 40 to cause the elastic force element 64 to be maintained at a partially extended condition.

Referring to FIGS. 9 through 12, the track members 44 may have a T slot 49 or a hook 132 or ring in the end plates 48 at each end of the track members 44. The elastic force element 64 may then be attached at one end to the elastic support connector 60, hook 132 or ring and at a second end in a first position to the end plate adjacent the connector element 40 and in a second position to the end plate opposite the connector element 40. When the elastic force elements 64 may be in the second position a user may rotate the foot pad 56 to exercise by moving their legs from an extended position to draw them together as in FIG. 9. One foot pad assembly 50 may be placed in a fixed position by use of pin aperture 38 and track pin 36. The user may then exercise by moving the second foot pad assembly 50 toward the fixed first foot pad assembly 50 as in FIG. 10.

The reciprocal inhibition body toner apparatus 10 may also be used to exercise the upper body of a user. When the elastic force elements 64 may be in the first position a user may kneel next to the track assembly 12 and place their hands on the foot pads 56 to force the foot pads 56 apart as in FIG. 11. The elastic force elements 64 may be placed in the second position and a user may then exercise by pulling or forcing the foot pads 56 together as in FIG. 12. Elastic force elements 64 may be attached in the first position and the second position simultaneously when it may be desired to have resistive force for exercise in both directions when using the track assembly 12.

Referring to FIGS. 1, 2, 5 and 8 the bottom cross member 14 may have tubular elements 70 attached to connector element 40. There may be an L shaped vertical support member 74 that may be slidably inserted at a lower end 76 into a first end 72 of a tubular element 70. Alternatively, the vertical support member 74 may have vertical frame members 16 attached to the two bottom cross members 14 that may be inserted at a lower end 76 in the first ends 72 of the tubular elements 70. There may be a front frame member 78 with two horizontal members 80 connected at a first end by the bridging cross member 26. The horizontal members 80 may be slidably inserted at a second end 73 into a tubular element 70. This embodiment may allow ease of assembly and disassembly of an exercise apparatus for storage, for transport or for use of parts of the apparatus as components with other exercise equipment. A tubular member or element may have a circular, oval, rectangular, triangular or other geometric cross section shape having closed walls and hollow interior.

Figure 2:
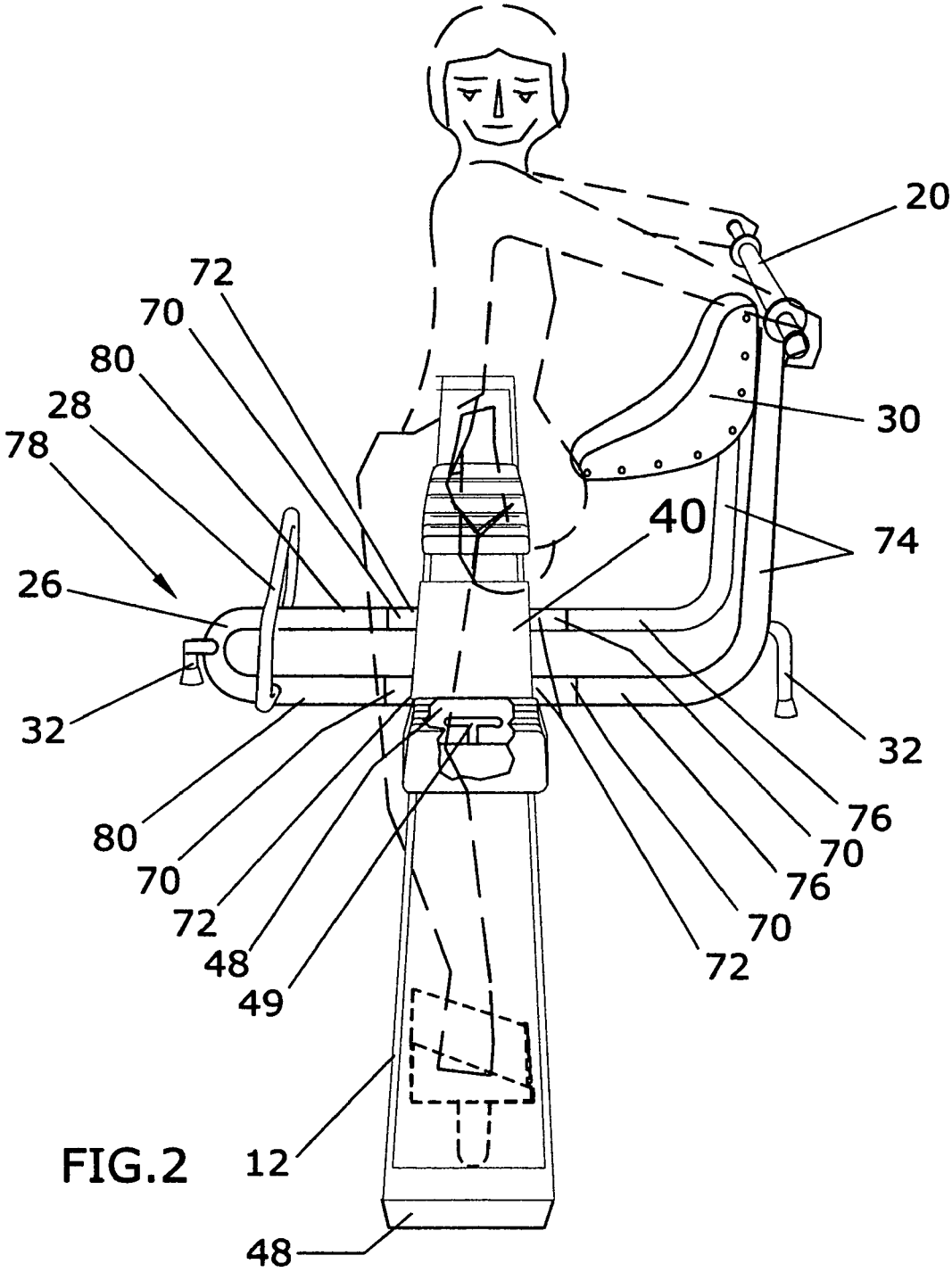
FIG. 2 illustrates a side perspective elevation view of the exercise apparatus according to an embodiment of the invention.
Figure 3:
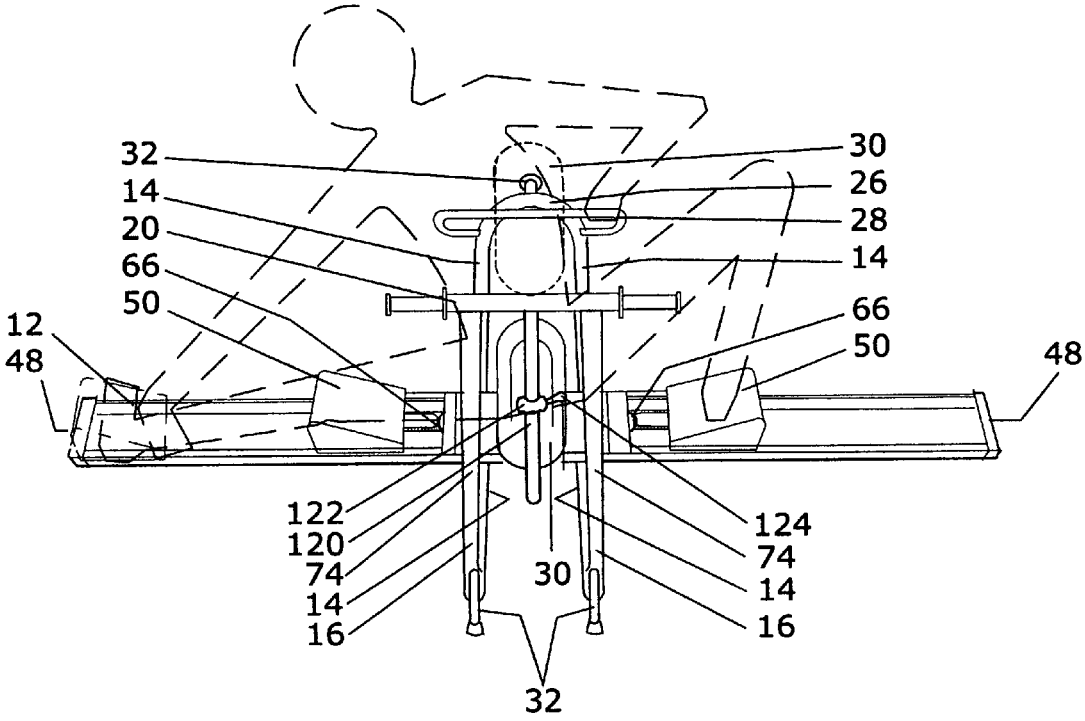
FIG. 3 illustrates a back perspective elevation view of the exercise apparatus according to an embodiment of the invention.
Figure 13:
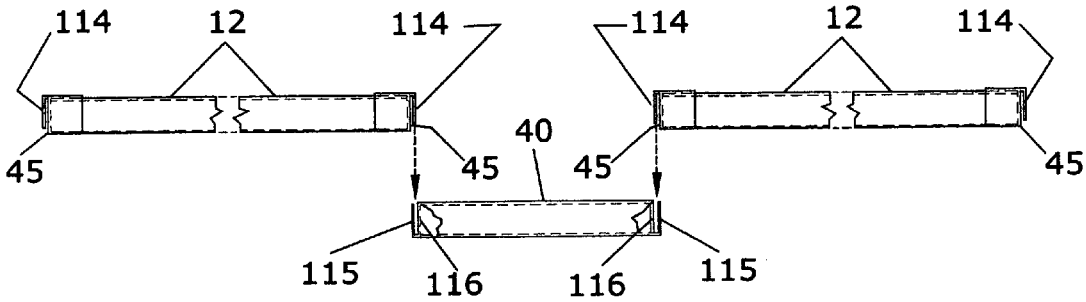
FIG. 13 illustrates a side elevation view of the track assembly according to an embodiment of the invention.
Figure 5:
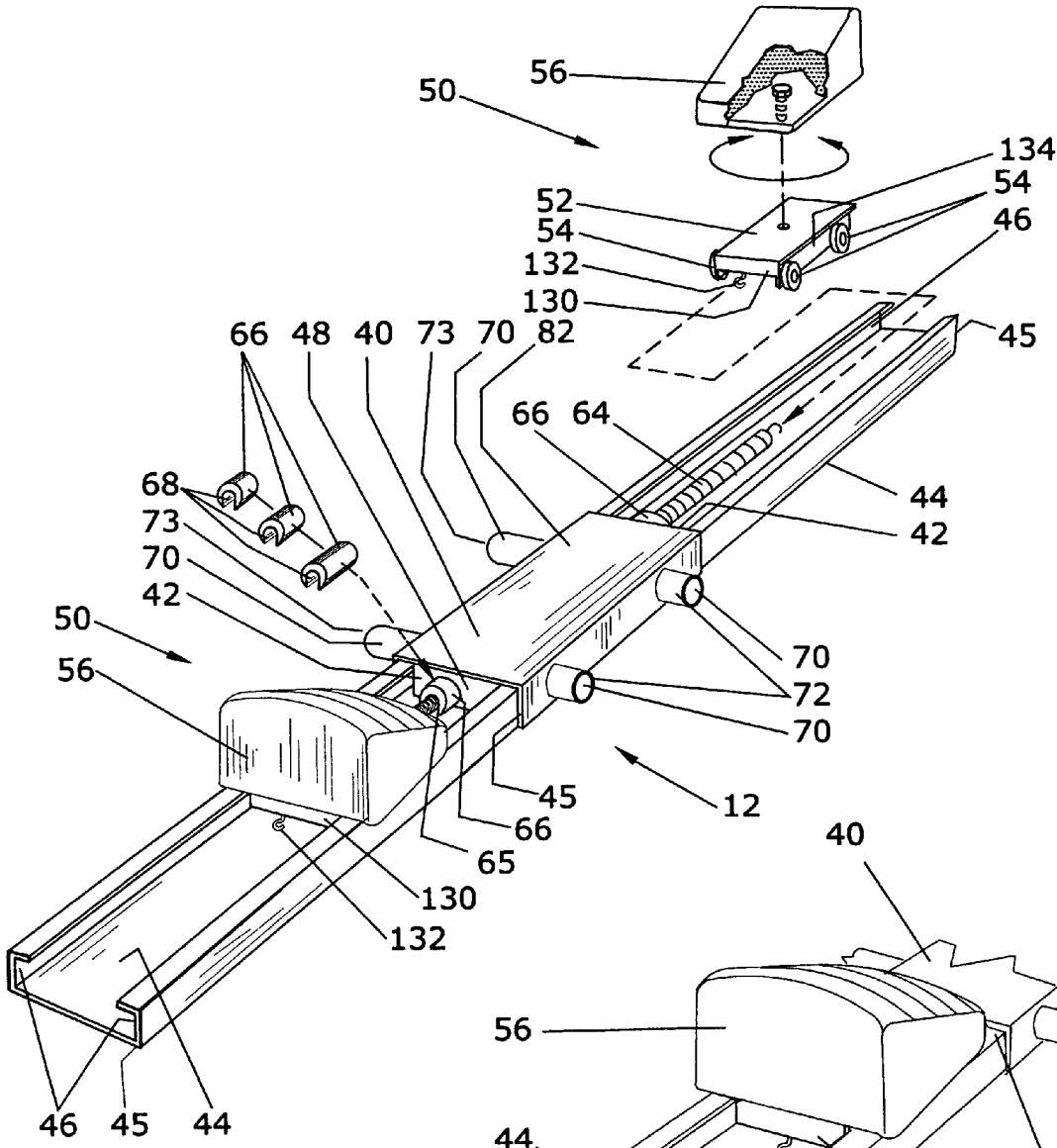
FIG. 5 illustrates a top perspective view of the track element according to an embodiment of the invention.
Figure 6:
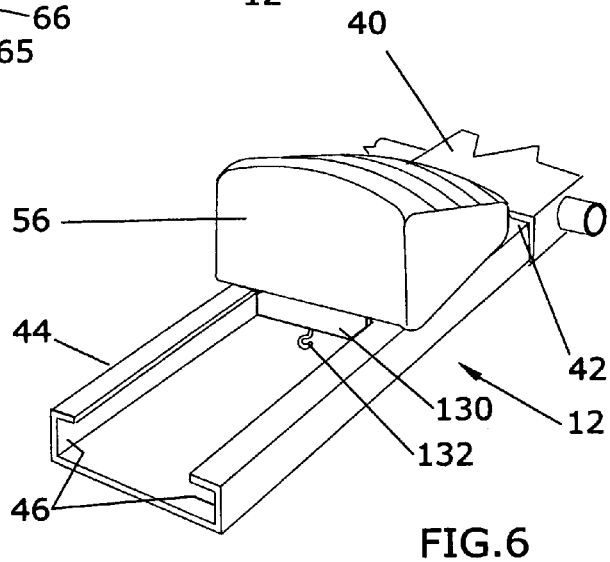
FIG. 6 illustrates a partial view of a footpad and track member according to an embodiment of the invention.
Figures 7, 8:
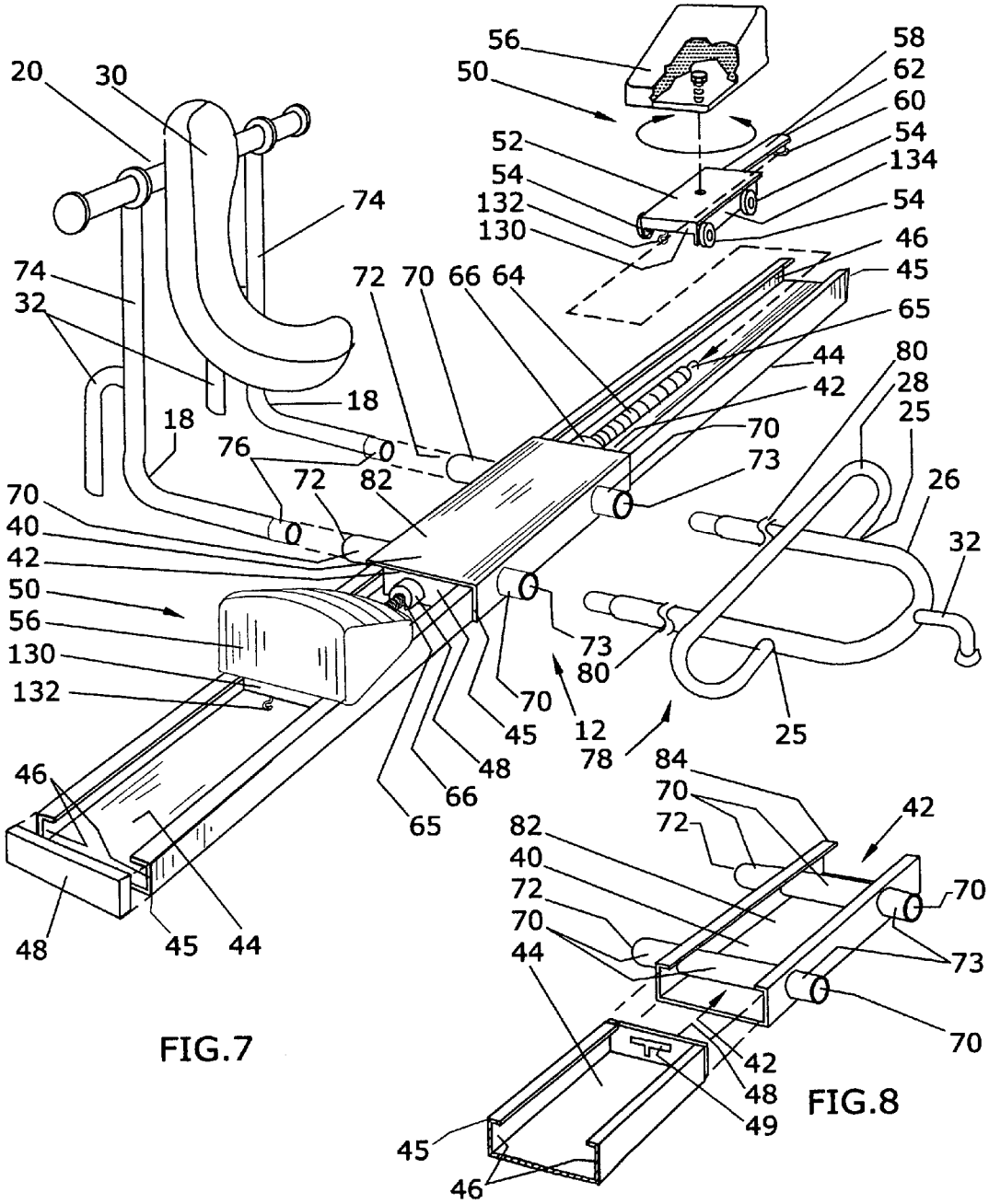
FIG. 7 illustrates a partial exploded elevation view of the exercise apparatus according to an embodiment of the invention.
FIG. 8 illustrate a partial exploded view of the track assembly according to an embodiment of the invention.
Figure 9:
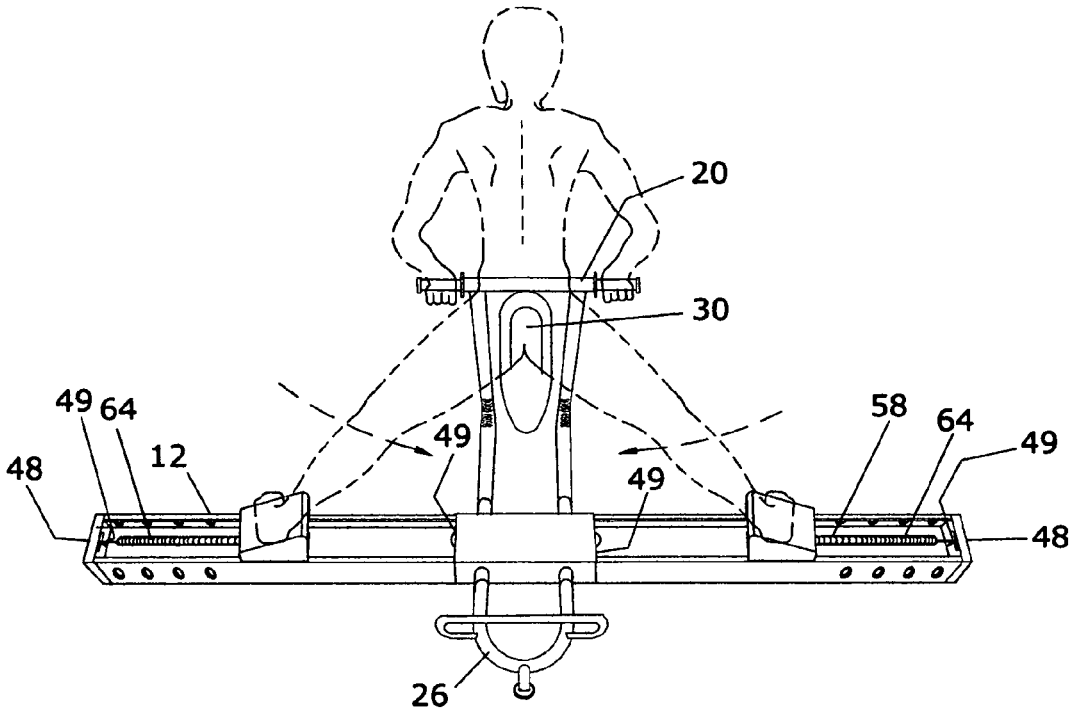
FIG. 9 illustrates a front perspective elevation view of the exercise apparatus according to an embodiment of the invention.
Figure 10:
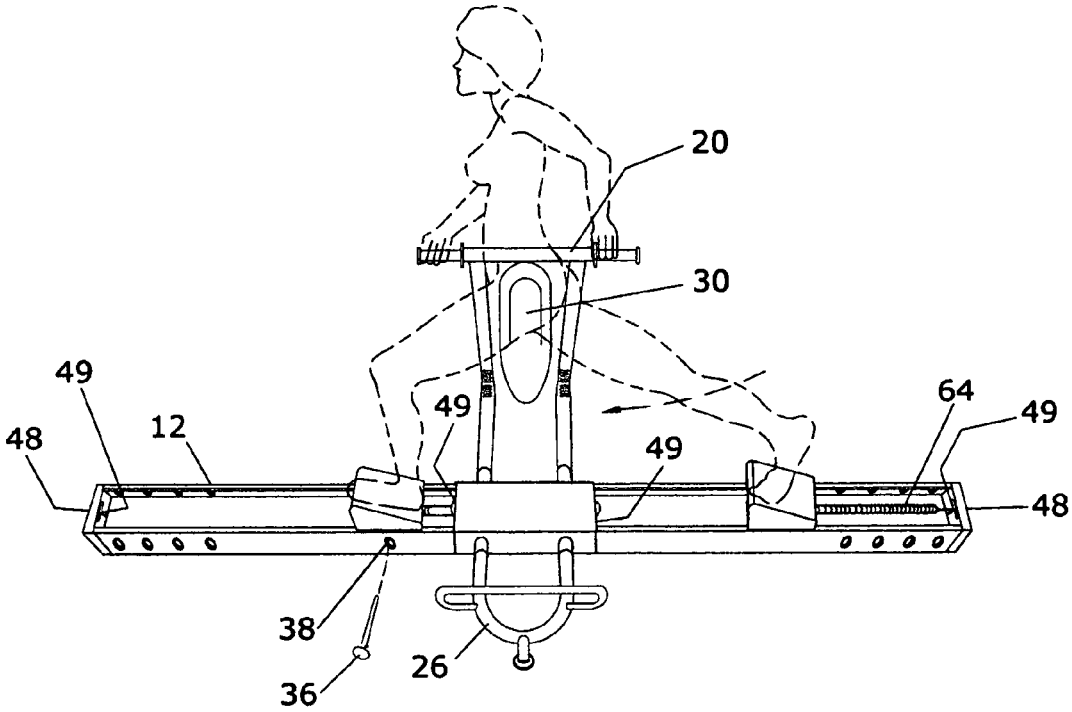
FIG. 10 illustrates a front perspective elevation view of the exercise apparatus according to an embodiment of the invention.
Figure 11:
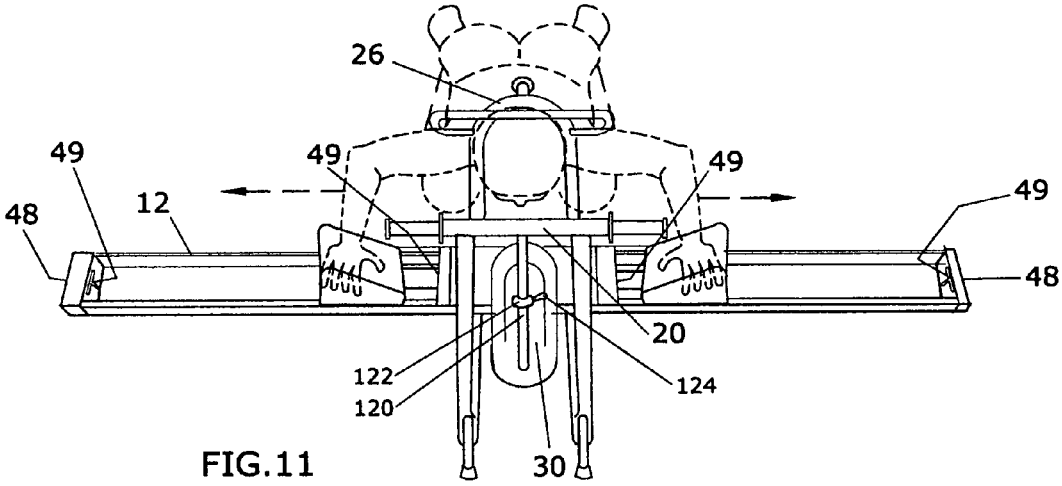
FIG. 11 illustrates a back perspective elevation view of the exercise apparatus according to an embodiment of the invention.
Figure 12:
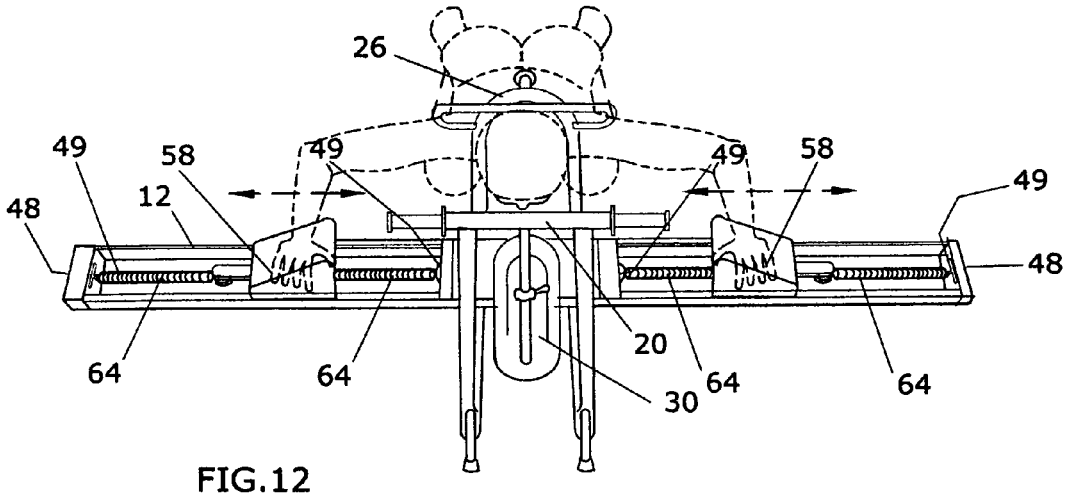
FIG. 12 illustrates a back perspective elevation view of the exercise apparatus according to an embodiment of the invention.

Referring to FIGS. 1, 2 and 7, there may be pedestals or legs 32 attached to vertical frame members 16 and bridging cross member 26 to aid in stability of the exercise apparatus 10. The legs 32 may be disposed downwardly to touch a floor or other support structure on which the exercise apparatus 10 may be positioned.

There may be an exercise grip bar 90 of generally semicircular, irregular shape and of tubular construction that may be attached to the second end 24 of the cross members 14 and to the handle 20. The attachment at the handle 20 may place that portion of the exercise grip bar 90 at approximately a user's shoulder height. As the exercise grip bar 90 extends toward the second end 24 it may curve away from the vertical plane of the bottom cross members 14 and down toward the horizontal plane of the bottom cross members 14 such that the exercise grip bar 90 is approximately the height of the user's knees before turning downward to attach to the second end 24.

The vertical frame members 16 and bottom cross members 14 may be rotationally connected with a latching element at first end 18 to allow folding of the vertical frame members 16 onto the center portion of the track assembly 12. The grip bar 28 may also be rotationally connected with a latching element at location 25 of bottom cross members 14. These rotational connection may allow collapsing of the apparatus 10 for storage or other purposes.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for human exercise comprising:

a track assembly having a longitudinal horizontal axis supporting a pair of slidable foot pads; two bottom cross members attached approximately perpendicular thereto and extending approximately horizontally from each side of said track assembly;

two vertical frame members attached to a first end of each of said bottom cross members;

a handle attached at an upper end of each of said vertical frame members; and a seat attached to in an upper portion of said two vertical frame members for seating a user facing a second end of said bottom cross member.

2. The apparatus as in claim 1 wherein said bottom cross members at said second end are connected by a bridging cross member.

3. The apparatus as in claim 1 wherein a grip bar is attached to each of said bottom cross members adjacent said second end and said grip bar extending upwardly therefrom.

4. The apparatus as in claim 1 wherein said seat is attached to said handle.

5. The apparatus as in claim 1 wherein:

a seat support member is attached to said handle disposed to extend downwardly therefrom;

a seat collar clamp attached to said seat at a back and said seat collar clamp slidably disposed on said seat support member; and said seat collar clamp having a clamp lever.

6. The apparatus as in claim 1 wherein said handle is a tubular structure attached to be disposed approximately parallel to said track assembly.

7. The apparatus as in claim 1 wherein said track assembly comprising:

a connector element of generally rectangular, box shape having two opposed recesses therein;

a track member slidably disposed in each of said recesses;

each of said track members having a generally open top with two opposed rail channels in said track members;

a wheeled platform of a foot pad assembly having a plurality of wheels disposed in said rail channels; and an elastic force element attached at a first end to said footpad assembly and at a second end to an end plate.

8. The apparatus as in claim 7 wherein said foot pad assembly having a foot pad rotatably attached to a top of said wheeled platform.

9. The apparatus as in claim 8 wherein said foot pad rotatable about 360 degrees.

10. The apparatus as in claim 7 wherein said wheeled platform having an extension arm extending outwardly relative to said connector element and horizontal and parallel to said track member; an elastic support connector attached at a distal end of said extension arm; and said elastic force element at said first end attached to said elastic support connector.

11. The apparatus as in claim 7 wherein said track members having said end plates having a T slot for receipt and retention of a second end of said elastic support element.

12. The apparatus as in claim 10 wherein:

said two track members each having a first end plate having a T slot therein disposed adjacent said connector element and a second end plate having a T slot therein disposed opposite said first end plate; and said elastic force member at said second end attachable in a first position to said first end plate and in a second position to said second end plate.

13. The apparatus as in claim 7 wherein a platform end plate is attached to said wheeled platform and a hook is attached to said platform end plate disposed for engagement with said elastic force element.

14. The apparatus as in claim 7 wherein said end plate having a hook attached and disposed for engagement with said elastic force element.

15. The apparatus as in claim 11 wherein a foot pad stop having a slot therein is disposed on said second end of said elastic support element intermediate said end plates and said foot pad assemblies.

16. An apparatus for human exercise comprising:

a track assembly having a longitudinal horizontal axis supporting a pair of slidable foot pads; a first two tubular elements attached at a first end approximately perpendicular to a front side of a connector element of said track assembly;

a second two tubular elements attached at a first end approximately perpendicular to a rear side of said connector element;

a vertical support member slidably inserted at a lower end into each of said second two tubular elements;

a handle attached at an upper end of each of said vertical support members;

a seat attached to said handle wherein said seat is disposed for seating a user facing said first two tubular elements; and a grip bar attached to each of said first two tubular elements adjacent a second end and said grip bar extending upwardly.

17. The apparatus as in claim 16 wherein a front frame member having two horizontal members is connected at a first end by a bridging member, said two horizontal members at a second end are slidably inserted in said first two tubular elements at said second end, and said grip bar is attached to each of said two horizontal members adjacent said bridging member.

18. The apparatus as in claim 16 wherein said track assembly comprising:

a connector element of generally rectangular, box shape having two opposed recesses therein;

a track member slidably disposed in each of said recesses;

each of said track members having two opposed rail channels therein;

a wheeled platform of a foot pad assembly having a plurality of wheels disposed in said rail channels; and an elastic force element attached at a first end to said footpad assembly and at a second end to an end plate.

19. The apparatus as in claim 18 wherein:

said two track members each having a first end plate having a T slot therein disposed adjacent said connector element and a second end plate having a T slot therein disposed opposite said first end plate; and said elastic force member at said second end attachable in a first position to said first end plate and in a second position to said second end plate.

20. The apparatus as in claim 8 wherein a platform end plate is attached to said wheeled platform and a hook is attached to said platform end plate disposed for engagement with said elastic force element.

21. The apparatus as in claim 18 wherein said track member having any end plate having a hook attached and disposed for engagement with said elastic force element.

22. The apparatus as in claim 16 wherein:

a seat support member is attached to said handle disposed to extend downwardly therefrom;

a seat collar clamp attached to said seat at a back and said seat collar clamp slidably disposed on said seat support member; and said seat collar clamp having a clamp lever.

23. An apparatus for human exercise comprising;

a track assembly having a connector element of generally rectangular, box shape having two opposed recesses therein;

a track member slidably disposed in each of said recesses wherein each of said track members having two opposed rail channels therein;

a wheeled platform of a foot pad assembly having a plurality of wheels disposed in said rail channels;

an elastic force element attached at a first end to said foot pad assembly and at a second end to an end plate;

two bottom cross members attached approximately perpendicular to said connector element and extending approximately horizontally from each side of said track assembly;

two vertical frame members attached to a first end of each of said bottom cross members;

a handle attached at an upper end of each of said vertical frame members;

a seat attached to said handle wherein said seat is disposed for seating a user facing a bridging cross member attached at a second end of said bottom cross members; and a grip bar attached to each of said bottom cross members adjacent said second end and said grip bar extending upwardly.

24. The apparatus as in claim 1 wherein an exercise grip bar is attached to said handle and to said second end.

25. The apparatus as in claim 24 wherein said exercise grip bar is attached to said handle positioned at a height between three feet and seven feet.

26. The apparatus as in claim 1 wherein said seat is disposed for attachment on a grip bar that is attached to each end of said bottom cross members adjacent said second end and said grip bar extending upwardly form said bottom cross members.

27. The apparatus as in claim 23 wherein:

said two track members each having a first end plate having a T slot therein disposed adjacent said connector element and a second end plate having a T slot therein disposed opposite said first end plate; and said elastic force member at said second end attachable in a first position to said first end plate and in a second position to said second end plate.

28. The apparatus as in claim 23 wherein a platform end plate is attached to said wheeled platform and a hook is attached to said platform end plate disposed for engagement with said elastic force element.

29. The apparatus as in claim 23 wherein said track member having an end plate having a hook attached and disposed for engagement with said elastic force element.

30. The apparatus as in claim 23 wherein:

a seat support member is attached to said handle disposed to extend downwardly therefrom;

a seat collar clamp attached to said seat at a back and said seat collar clamp slidably disposed on said seat support member; and said seat collar clamp having a clamp lever.

31. An apparatus for human exercise comprising;

a track assembly having a connector element having two opposed recesses therein;

two track members each having an end plate slidably disposed in each of said recesses wherein each of said track members having two opposed rail channels therein;

a wheeled platform of a first foot pad assembly having a plurality of wheels disposed in a first two opposed rail channels and a wheeled platform of a second foot pad assembly having a plurality of wheels disposed in a second two opposed rail channels; and an elastic force element attached at a first end to each of said foot pad assembly and at a second end to said end plate.

32. The apparatus as in claim 31 wherein:

two tubular elements attached approximately perpendicular to said connector element and extending approximately horizontally from each side of said track assembly;

two vertical frame members attached to a first end of each of said tubular elements; and a handle attached at an upper end of each of said vertical frame members.

33. The apparatus as in claim 32 wherein a seat attached to said handle wherein said seat is disposed for seating to face a second end of each of said tubular elements.

34. The apparatus as in claim 32 wherein:

a seat support member is attached to said handle disposed to extend downwardly therefrom;

a seat collar clamp attached to said seat at a back and said seat collar clamp slidably disposed on said seat support member; and said seat collar clamp having a clamp lever.

35. The apparatus as in claim 32 wherein a grip bar attached to a second end of each of said tubular elements adjacent said second end and said grip bar extending upwardly.

36. The apparatus as in claim 35 wherein a seat attached to said grip bar wherein said seat is disposed for seating to face said two vertical frame members.

37. The apparatus as in claim 31 wherein said connector element is partially open at one of a top side and a bottom side.

38. The apparatus as in claim 31 wherein said track members having said end plates having a T slot for receipt and retention of said second end of said elastic support element.

39. The apparatus as in claim 32 wherein a front frame member having a pair of horizontal members and a bridging cross member attached to a second end of each of said tubular elements.

40. The apparatus as in claim 39 wherein a grip bar attached to said front frame member and said grip bar extending upwardly.

41. The apparatus as in claim 31 wherein said two opposed rail channels having a pin aperture therein for insertion of a track pin.

42. The apparatus as in claim 31 wherein said connector element is of generally rectangular, box shape.

43. The apparatus as in claim 31 wherein:

said two track members each having a first end plate having a T slot therein disposed adjacent said connector element and a second end plate having a T slot therein disposed opposite said first end plate; and said elastic force member at said second end attachable in a first position to said first end plate and in a second position to said second end plate.

44. The apparatus as in claim 31 wherein a platform end plate is attached to said wheeled platform and a hook is attached to said platform end plate disposed for engagement with said elastic force element.

45. The apparatus as in claim 31 wherein said end plate having a hook attached and disposed for engagement with said elastic force element.

46. The apparatus as in claim 31 wherein:

a plate is attached to said connector element at each of said two opposed recesses to close said two opposed recesses;

a first flange is attached to said plate; and a second flange is attached to said end plate disposed for insertion in said first flange.

47. The apparatus as in claim 1 wherein said two vertical frame members are rotatably attached to said first end of said bottom cross members.

48. The apparatus as in claim 3 wherein said grip bar is rotatable attached to each of said bottom cross members.

* * * * *